United States Patent [19]

Bostroem

[11] 3,941,906

[45] Mar. 2, 1976

[54] HOT DIP METALLIZING PROCESS

[76] Inventor: Theodore Bostroem, 460 Park Road Extension, Middlebury, Conn. 06762

[22] Filed: Dec. 17, 1973

[21] Appl. No.: 425,081

Related U.S. Application Data

[63] Continuation-in-part of Ser. No. 337,172, March 1, 1973.

[52] U.S. Cl. ..... 427/360; 427/365; 427/367; 427/406; 427/433; 427/312

[51] Int. Cl.[2] ..... C23C 1/00

[58] Field of Search ..... 117/114 R, 114 A, 114 C, 117/71 M, 51, 52, 102 A, 102 M, 19, 131; 427/365, 367, 406, 433, 312

[56] References Cited

UNITED STATES PATENTS

| | | | |
|---|---|---|---|
| 2,570,906 | 10/1951 | Alferieff | 427/360 |
| 2,978,355 | 4/1961 | Busch | 427/360 |

*Primary Examiner*—Mayer Weinblatt
*Assistant Examiner*—Edith R. Buffalon
*Attorney, Agent, or Firm*—Erich M. H. Radde

[57] ABSTRACT

The improved hot dip metallizing process of this invention comprises passing the article to be metallized, such as a ferrous metal article, through a bath of a molten heavy metal, such as lead, and conducting the article therefrom through a layer of molten coating metal, such as zinc, confined in a stack-like structure of a cross-sectional area being a small fraction of the surface area of the heavy metal bath. The molten coating metal is continuously supplied to the stack, preferably through orifices or nozzles so as to remove any droplets of molten heavy metal adhering to the surface of the article, thereby causing metallizing of the article and continuous overflow of excess molten coating metal at the top of the stack. Before hot blasting the coated metallic article it may be passed through mechanical removal means, such as counter-rotating rollers to remove the major part of excess coating metal, while the remainder is removed by hot blasting.

8 Claims, 3 Drawing Figures

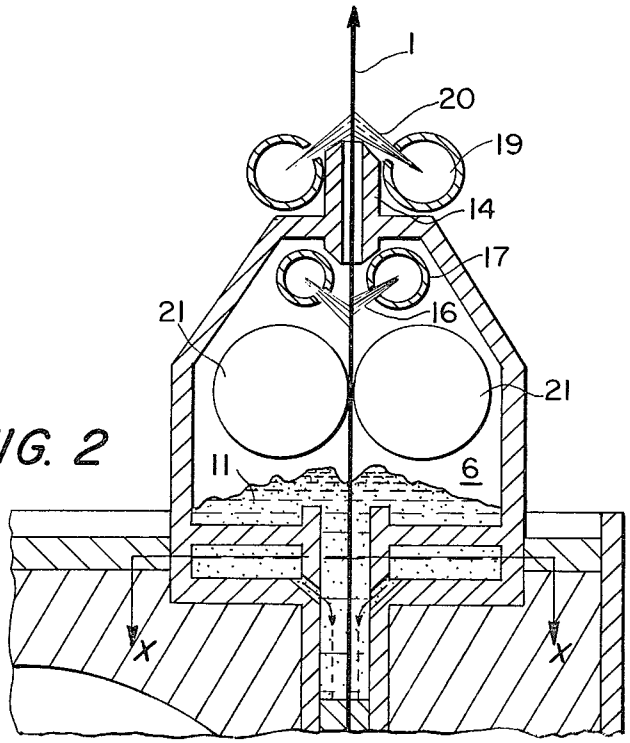
FIG. 2
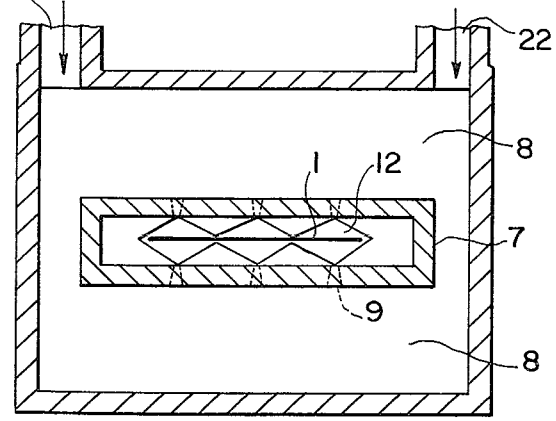
FIG. 3
FIG. 1
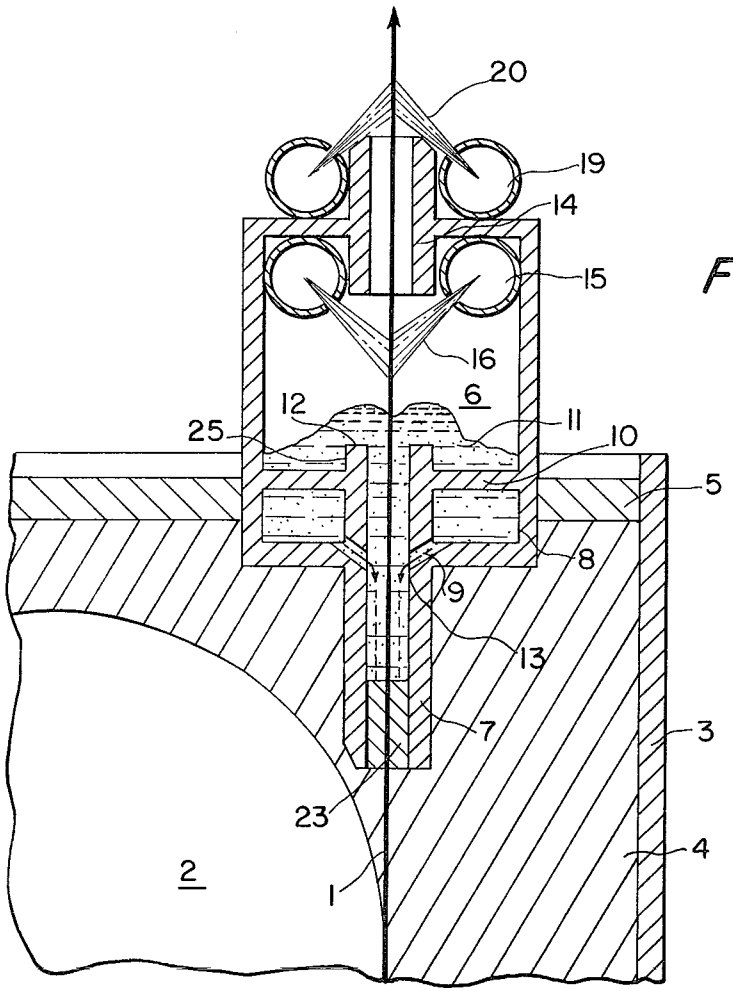

HOT DIP METALLIZING PROCESS

CROSS-REFERENCE TO RELATED APPLICATION

The present application is a continuation-in-part of copending Application Ser. No. 337,172, filed Mar. 1, 1973, and entitled "Process of hot dip metallizing of metallic articles and apparatus".

BACKGROUND OF THE INVENTION

1. Field of the Invention

The present invention relates to an improved process of applying metallic coatings to metal articles and more particularly to an improved procedure in the hot dip metallizing process of steel and other metal articles and to hot dip metallized articles obtained thereby.

2. Description of the Prior Art

In copending application Ser. No. 337,172 there is disclosed and claimed a hot dip metallizing process which consists in principe in a. passing the article to be metallized through a bath of a molten heavy metal, preferably lead, said metal having a specific gravity higher than that of the coating metal and being substantially non-corrosive to the metal of the article to be coated, and b. conducting the article from said molten heavy metal bath through a confined layer of the molten coating metal such as zinc, for instance, in a stack, the surface area of said confined coating metal layer being a small fraction of the surface area of the heavy metal bath, said confined layer floating on said heavy metal and being of predetermined and limited height, thereby limiting the time of contact between the metal article to be coated and the coating metal to a predetermined limited time to achieve a coating of a predetermined character and avoiding any attack of the equipment by the coating metal.

This process has the advantage that the contact between zinc and the steel of the strip is of extremely short duration. Said process also provides means for regulating the level of the zinc in the stack by compensating for the consumption of the available amount of molten zinc in the stack, as the galvanizing operation proceeds. Said process also provides for periodic and automatic addition of molten zinc to the stack, creating an overflow of the zinc above the stack top. Thereby, any top dross formed, which consists mainly of oxides, is carried along towards the zinc melting oven, where the top dross is de-oxidized back to metallic zinc for further re-use.

It has been found that, under certain conditions, the strip to be metallized will pick up physically (or mechanically) small amounts of molten lead usually in the form of droplets which adhere to the metal strip to be metallized. Such adhering lead droplets, or the like, when penetrating into the zinc bath floating on the lead in the stack, will prevent uniform metallizing or galvanizing of the strip surface by forming "blisters" on the finished strip surface, a feature inadmissible for producing prime metallized articles.

Likewise, due to the extremely short duration of the contact between strip and zinc, the differences in the height of the zinc column in the stack, while staying within admissible tolerances (of height and, therefore, duration), have the disadvantage that such periodic, noncontinuous top dedrossing procedure introduces discontinuously into the zinc melting oven larger or smaller amounts of top dross and that, as a result thereof, deoxidizing of the top dross also takes place discontinuously and from time to time. It is evident that such discontinuous dedrossing and de-oxidizing has a number of disadvantages and needs improvement.

SUMMARY OF THE INVENTION

It is one object of the present invention to provide a simple and effective process which overcomes the disadvantages frequently encountered when proceeding according to the process disclosed and claimed in application Ser. No. 337,172 which is made part of the present specification by reference.

Another object of the present invention is to provide hot dipped metal articles by carrying out said improved process of hot dip metallizing.

Other objects of the present invention and advantageous features thereof will become apparent as the description proceeds.

In principle, the process according to the present invention consists in supplying the molten zinc to the zinc containing stack in quantities far greater than those required for galvanizing proper. Preferably the molten zinc is introduced into the stack on both sides of the strip to be metallized through appropriately formed orifices, such as nozzles. Thereby, a sweeping effect is produced on the strip surfaces. Such sweeping is sufficient to remove the "physically" adhering droplets of lead from the strip surface. Due thereto intimate contact of the molten zinc on the entire surface of the strip is achieved. Of course, the zinc jets are introduced through said orifices into the zinc zone, preferably into the molten zinc in the lower part of the stack. The centerline of the zinc jets should be substantially downwardly directed, i.e. at an angle substantially opposed to the direction of the ascending strip in the stack.

Thereby, the excess of molten zinc thus introduced into the stack creates a permanent overflow at the top of the stack. Said overflow together with any top dross formed is conducted continuously into the zinc melting oven and is de-oxidized continuously therein. In contrast to prior procedures any top dross formed in the stack arrives in the oven not periodically in batches but in a continuous flow of very fine particles which can be de-oxidized very readily because of their fine structure and the resulting ease of chemical exchange reaction with the de-oxidizing agents which float on the surface of the molten zinc in the melting oven.

Continuous overflow of the zinc over the top of the stack has the further advantage that exposure of the strip to the molten zinc will be most uniform, thus resulting in a very uniform galvanized product.

Supplying the molten zinc to the coating bath can be effected with great simplicity, since it requires only a constant speed motor driving a zinc pump continuously while coating proceeds. A stand-by motor and pump may be provided as in any known responsible operation.

According to a specific embodiment of the present invention an enclosed tunnel for introducing the molten zinc surrounds the stack. Said tunnel is located underneath the overflow trough. The required orifices or nozzles are provided on its interior walls. The orifices, nozzles, or the like, must, of course, be constructed so that both strip surfaces are adequately swept by the zinc jets so that the adhering lead droplets are completely removed from the strip.

According to another embodiment of the present invention, there are provided suitable mechanical means and preferably a pair of counterrotating rollers immediately following the exit of the metallized strip from the zinc overflow zone at the top of the stack, and in advance of the strike or impingement of the non-oxidizing hot gas jets, said means being continually employed to remove excess zinc from the coated metal strip.

The use of such rollers is manyfold. Firstly they remove a major part of the zinc from the strip as it emerges from the zinc overflow of the stack. As a result thereof the hot gas blast has merely to "polish" the zinc removal operation.

Secondly they stabilize "in space" the body of the traveling strip, so that the distance variation between the opposed hot blast nozzles and the strip is reduced to next to nothing. This enables selection of a very short distance between nozzles and strip and also results in a reduction of the hot gas pressure and flow. For the same reason it is possible to reduce the cross-section of the strip exit orifice, thus to facilitate maintaining in the galvanizing chamber an atmosphere of a lower oxidizing power or even a non-oxidizing atmosphere. As a result thereof, formation of any top dross is considerably reduced or even completely eliminated.

Preceding removal of the greater part of excess molten zinc by said rollers provided in advance of the hot gas jets facilitates to a considerable degree selection of the proper angle of inclination of the axis of the hot gas spray with regard to the strip. The roller bodies drastically eliminate any danger of creating turbulences at the upper zinc level, i.e. the zinc overflow of the stack. Due thereto certain restrictions regarding the analytical composition of the metal alloy used for coating the metal strip, or the like, which were heretofore necessary, can be eased.

It will be noted that immediate quenching of the freshly coated strip as it emerges from the galvanizing chamber allows to locate the deflecting pulley considerably closer to the strip exit from the galvanizing device as compared to conventional galvanizing units. Such a pulley will act only when the zinc coating has sufficiently cooled, i.e. has solidified.

Simultaneous action of the "rough" zinc removing and strip stabilizing pulley with that caused by the immediate quenching of the strip reduces the "unguided" portion of the strip to a mere fraction of that required in a conventional galvanizing installation, thus effecting an unprecedented strip stability in the hot blast zone.

This, in its turn, enables to use more economical hot gas jets located closer to the strip plane with much less critical jet angle values than is recommended by the prior art.

BRIEF DESCRIPTION OF THE DRAWINGS

In further description of the invention, reference will be had to the accompanying drawings, wherein like numerals are used to denote like parts wherever possible.

FIG. 1 is a cross-sectional view of a lead-zinc galvanizing arrangement showing the overflow of the zinc over the top of the stack, the tunnels for introducing the molten zinc under pressure, and the zinc supplying nozzles;

FIG. 2 is a cross-sectional view of a similar arrangement with the addition of a pair of rollers for preliminary zinc removal and strip stabilization; and FIG. 3 is a plan view along the line X—X of FIGS. 1 and 2.

DESCRIPTION OF THE PREFERRED EMBODIMENTS

In said FIGS. 1 to 3 the metal strip 1 to be galvanized is conducted by means of sinking roll 2 (shown only partly) through lead bath 4 contained in galvanizing pot 3 which is also shown only partly. Lead bath 4 is covered by oxidation-proof layer 5 floating on the lead bath, such as salt or the like to prevent its oxidation. Stack 7 is placed into galvanizing chamber 6 at its one end. Molten zinc 10 is introduced into stack 7 and floats on molten lead layer 23 which partly extends into stack 7. The upper part of stack 7 is enclosed by chamber 6 so that zinc overflow 11 emerging from stack top 25 collects together with any top dross formed in trough 12 formed by the walls of chamber 6 and the stack top 25 and is returned through a conduit (not shown) by gravity or other means such as continuous pumping into the zinc melting and supply oven (not shown). Underneath the bottom of said chamber 6 there is provided tunnel-like channel 8. Molten zinc is supplied to said channel 8 from the zinc melting and supply oven by means of a pump (not shown) through conduits 22 as shown in FIG. 3 and is forced through nozzle-like orifices 9 under pressure into stack 7. Said nozzle-like orifices 9 are arranged so that they direct the molten zinc jets 13 discharged therefrom onto metal strip 1 passing from sinking roll 2 through stack 7 and chamber 6. The molten zinc jets 13 impinging upon strip 1 remove droplets of molten lead adhering to strip 1 on entering stack 7 and leaving lead layer 23.

Chamber 6 has at its top opening 14 through which the zinc coated metal strip 1 leaves said chamber 6. Header 15 is arranged in the upper part of chamber 6 and supplies a hot non-oxidizing gas such as nitrogen to nozzles provided in header 15 in such a manner that the gas jets 16 emerging from said nozzles impinge upon zinc coated metal strip 1 and completely remove any adhering zinc droplets therefrom. The strip 1, after it has passed through strip exit opening 14, is then quenched outside chamber 6 by means of cooling quenching fluid forced through nozzles provided in header 19.

In FIG. 2 there is additionally provided in chamber 6 a pair of rollers 21 which stabilize the strip during its passage through chamber 6 and exit opening 14 and which preliminarily remove part of the zinc droplets adhering to strip 1.

FIGS. 1 and 2 differ somewhat from each other by the provision of rollers 21 in chamber 6 of FIG. 2. It is evident that provision of said stabilizing and preliminary zinc removal rollers 21 has the following advantages:

a. The strip exit opening 14 in FIG. 2 is narrower than the corresponding opening 14 of FIG. 1. As a result thereof maintaining a non-oxidizing atmosphere in Chamber 6 is considerably facilitated.

b. The hot blasting jets 16 can be arranged more closely to the zinc coated strip 1 than in FIG. 1 because swaying and wobbling of the strip emerging from the zinc 10 in stack 7 is eliminated to a large extent by rollers 21. Another advantage achieved thereby is the reduction in the amount of hot blasting gas due to the smaller opening 14.

c. Any turbulence produced by the hot blasting jets 16 impinging upon the zinc overflow 11 as in FIG. 1 is completely eliminated by providing the pair of rollers 21 as shown in FIG. 2.

It is evident that provision of the pair of rollers 21 located between the exit of the zinc coated metal strip 1 from stack 7 and the header 15 results in a number of important and by no means negligible technical and economical advantages.

The following example serves to illustrate the present invention without, however, limiting the same thereto.

EXAMPLE

A cold rolled steel strip 1, 28 inches (711 mm.) wide by 0.016 inch (0.40 mm.) thick, travelling at 200 ft./min. (ca 60 m./min.) through the lead bath 4 emerges vertically therefrom, enters stack 7 in which a column of zinc 10, 12 inches (305 mm.) high, floats on the lead layer 23. The vertical length of stack 7 is at least 15 inches (381 mm.) so as to prevent any zinc from passing out at the bottom of stack 7 into lead bath 4.

About 6 inches (152 mm.) from stack top 25, i.e. about half the way of the zinc column maintained in stack 7, there is provided a horizontal row of flat, solid jet-producing nozzles 9 located on the walls of stack 7. Molten zinc is forced from tunnels 8 surrounding stack 7 through said nozzles 9 against the two surfaces of strip 1. The zinc jets 13 emerging from said nozzles 9 remove the droplets of lead which may adhere to strip 1 by surface tension (not chemically, and also not by alloying). Being hit by the zinc stream 13 at an angle, for instance, of 45° in downward direction, the droplets of lead have a tendency to flow into and unite with the column of lead 23 in the lower part of stack 7.

The velocity of the molten zinc 13 emerging from nozzles 9 and hitting strip 1 may vary, for instance, from 3 ft./sec. to 9 ft./sec. (1 to 3 m./sec.), mainly depending on the surface condition of the strip, i.e. the smoother the strip surface, the lower may be the jet velocity.

The strip stabilizing and preliminary zinc removing rollers 21 can be made of ceramic material, for instance, carborundum or the like, or of ceramic-coated heat resistant steel; their diameter may be 8 inches (203 mm.) and, with proper lateral strip guiding by conventional means, a face body of, for instance, 30 inches (760 mm.) may be used. A pressure of 22 lbs. (10 kg.) may exist between rollers 21. Rollers 21 may be driven or not, because the strip is at a temperature well under the steel softening value.

As mentioned hereinabove, the use of the stabilizing and preliminary zinc removing rollers 21 allows to reduce the distance from the hot gas nozzles of heade 15 to strip 1, for instance, from ⅜ inch (10 mm.) as in FIG. 1 to 3/16 inch (5 mm.) as in FIG. 2 and even closer. Likewise, the hot gas pressure can be reduced from, for instance, 4 Psi (0.26 kg./sq.cm.) to 2 Psi (0.13 kg./sq.cm.). The gap of the strip exit slot 19 may also be reduced from, for instance ½ inch (12 mm.) to, for instance, ¼ inch (6 mm.), whereas the angle between the hot gas center line and the plane of strip 1 could be, for instance, 80°, adjustable by ± 10° in downward direction. Finally, if one continuous slot is used across the whole strip, it could be reduced from a width of 0.031 inch to a width of 0.020 inch (0.8 mm. to 0.5 mm.) depending on the degree of flatness of strip 1 being galvanized. It is evident that the flatter the strip, the narrower the slot in the gas nozzles and, therefore, the lower will be the gas consumption because, if the strip is wobbling and swaying on passing through chamber 6, the more gas must be used to compensate for the wobble and swaying of the passing strip.

Although the hot dip metallizing process and apparatus according to the present invention have been described hereinabove for hot dip metallizing of a steel strip with zinc, the process and apparatus can also be applied to other hot dip metallizing operations such as to hot dip aluminizing and the like.

I claim:

1. A process of hot dip metallizing ferrous articles by passing the article to be metallized through a bath of molten lead and conducting the article from said molten lead bath through a confined layer of the molten coating metal, the surface area of said confined coating metal layer being a small fraction of the surface area of the lead bath, said confined layer floating on said lead and being of predetermined and limited height, thereby limiting the time of contact between the ferrous article to be coated and the coating metal to a predetermined limited time to achieve a coating of a predetermined character and avoiding any attack of the equipment by the coating metal, the improvement which consists in supplying the molten coating metal to said confined layer of coating metal in quantities substantially exceeding the quantity required for metallizing the ferrous article in such a manner that droplets of molten lead adhering to the ferrous article on passing into the confined layer of molten coating metal are substantially completely removed from the surface of the ferrous article to be hot dip metallized, thereby causing continuous overflow of molten coating metal at the top of the confined layer of molten coating metal.

2. The process of claim 1, in which jets of molten coating metal are supplied to the confined layer of said coating metal so as to intimately contact the entire surface of the ferrous article to be metallized.

3. The process of claim 2, in which the jets of molten coating metal are directed at an angle substantially opposed to the direction of the ferrous article passing through said confined zone of molten coating metal.

4. The process of claim 1, in which the overflow of molten coating metal and any top dross formed is continuously returned into the supply means for the molten coating metal and in which metal oxide present in the overflow is continuously de-oxidized in said supply means.

5. The process of claim 1, in which the metal coated article, after leaving the confined layer of molten coating metal, is subjected to non-oxidizing hot blasting for removal of excess coating metal from the surface of the metal coated article, whereafter said article is quenched.

6. The process of claim 1, in which the major part of excess coating metal is mechanically removed from the surface of the metal coated article, after leaving the confined layer of molten coating metal, whereafter substantially complete removal of excess coating metal is effected by subjecting said metal coated article to non-oxidizing hot blasting.

7. The process of claim 6, in which mechanical removal of excess coating metal is effected by passing the metal coated article through a pair of counterrotating rollers.

8. A process of hot dip metallizing ferrous articles by passing the article to be metallized through a bath of molten lead and conducting the article from said molten lead bath through a confined layer of molten zinc, the surface area of said confined zinc layer being a small fraction of the surface area of the lead bath, said confined layer floating on said lead bath and being of predetermined and limited height, thereby limiting the time of contact between the ferrous article to be zinc coated and the coating zinc to a predetermined limited time to achieve a coating of a predetermined character and avoiding any attack of the equipment by the coating zinc, the improvement which consists in supplying the molten coating zinc to said confined layer of zinc in quantities substantially exceeding the quantity required for metallizing the ferrous article in such a manner that droplets of molten lead adhering to the ferrous article on passing into the confined layer of molten coating zinc are substantially completely removed from the surface of the ferrous article to be hot dip metallized, thereby causing continuous overflow of molten coating zinc at the top of the confined layer of molten coating zinc.

* * * * *